US007882590B2

(12) United States Patent
Helma

(10) Patent No.: US 7,882,590 B2
(45) Date of Patent: Feb. 8, 2011

(54) DOUBLE-SIDED MEDIA CLEANING APPARATUS AND METHOD

(75) Inventor: Thomas Richard Helma, Wakefield, RI (US)

(73) Assignee: ZIH Corp., Hamilton (BM)

( * ) Notice: Subject to any disclaimer, the term of this patent is extended or adjusted under 35 U.S.C. 154(b) by 1174 days.

(21) Appl. No.: 11/460,040

(22) Filed: Jul. 26, 2006

(65) Prior Publication Data

US 2007/0023068 A1 Feb. 1, 2007

Related U.S. Application Data

(60) Provisional application No. 60/702,880, filed on Jul. 27, 2005.

(51) Int. Cl.
*B08B 11/00* (2006.01)

(52) U.S. Cl. ..... 15/256.52; 15/102; 399/123

(58) Field of Classification Search ..... 15/77, 15/256.52, 102; 399/123; 400/701
See application file for complete search history.

(56) References Cited

U.S. PATENT DOCUMENTS

| | | | | |
|---|---|---|---|---|
| 4,009,047 | A * | 2/1977 | Lindsay | 134/9 |
| 6,200,392 | B1 * | 3/2001 | Korbonski | 134/9 |
| 6,285,845 | B1 | 9/2001 | Liatard et al. | |
| 2002/0023307 | A1 * | 2/2002 | Haba et al. | 15/3 |
| 2005/0084315 | A1 | 4/2005 | Lodwig et al. | |
| 2008/0024581 | A1 | 1/2008 | Nakayama | |
| 2008/0184903 | A1 | 8/2008 | Kaneoya et al. | |

FOREIGN PATENT DOCUMENTS

| | | | |
|---|---|---|---|
| GB | 2 230 738 | A | 10/1990 |
| JP | 59001285 | A | 1/1984 |
| JP | 59182768 | A | 10/1984 |
| JP | 1991-105919 | | 11/1991 |

OTHER PUBLICATIONS

PCT International Search Report/Written Opinion; International Application No. PCT/US2010,020423; Apr. 28, 2010; 10 pages.

* cited by examiner

*Primary Examiner*—Randall Chin
(74) *Attorney, Agent, or Firm*—Alston & Bird LLP

(57) ABSTRACT

The present invention provides a cleaning assembly for use in a media processing device. In various embodiments, the cleaning assembly includes a first roller that at least partially engages a second roller, and a media feed path that passes between the first roller and the second roller. There may also be a third roller that at least partially engages the second roller, and which may be replaceable. In one embodiment, the second roller defines a surface adherence that is greater than a surface adherence of the first roller and the third roller defines a surface adherence that is greater than the surface adherence of the second roller. As a result, the present invention provides a cleaning assembly capable of cleaning opposed surfaces of a media unit in a single pass.

6 Claims, 9 Drawing Sheets

DOUBLE-SIDED MEDIA CLEANING APPARATUS AND METHOD

CROSS-REFERENCE TO RELATED APPLICATIONS

This application claims priority from U.S. Provisional Application No. 60/702,880 filed Jul. 27, 2005, which is hereby incorporated herein in its entirety by reference.

BACKGROUND OF THE INVENTION

1. Field of the Invention

The present invention is directed to a cleaning method, assembly, and system for cleaning media used in media processing devices. Specifically, the present invention is directed to a double-sided printable media cleaning apparatus and method.

2. Description of the Related Art

Conventional feed devices are used for feeding or transporting stock materials such as plastic cards, paper, and the like. For example, a typical printer defines a feed path along which stock is transported during printing. Rollers are disposed along the feed path and oriented generally perpendicular to the feed direction of the stock. The rollers are typically configured in pairs to define nips for engaging the stock in the feed path so that rotation of the rollers causes the stock to be fed or transported along the path.

It is known that debris such as dust, oil, moisture, ink, and the like can be introduced into the feed path and can interfere with the operation of the feeding or other processing of the stock. For example, if rollers are used to transport the stock through the feed path, the debris can interfere with the frictional engagement between the rollers and the stock. Further, in the case of a printer, the debris can interfere with the operation of the printing mechanism therein. For example, a card printer for thermally printing plastic cards can include a printhead that disposes dye onto the cards, a magnetic head that programs a magnetic strip on the card, a smart card contact station with an electrical contact that contacts a conductive pad on the card to communicate with a chip on the card, and/or a lamination mechanism with heat rollers that applies laminates to the surfaces of the card. The operation of the printhead, the magnetic head, the smart card contact station, and the lamination mechanism can be compromised by the presence of debris in the printer, thereby having a negative impact on the quality of the printed product.

In conventional cleaning operations, printable media such as cards that are normally fed through the device are substituted with a cleaning card. Such cleaning cards are typically fed through the printer in a conventional manner and are generally similar in size to stock printable media. A typical cleaning card has a plastic core layer that is sandwiched between layers of felt that are soaked with isopropyl alcohol or the like so that the rollers and/or the heads of the printer are cleaned as the cleaning card is fed through the printer. By routinely feeding such a cleaning card through the printer, the feed path can be cleaned to maintain the proper operation of the printer. However, if the cleaning operation is not performed, or is performed with insufficient frequency, the printer will not be kept clean. In some cases, an operator of the printer may neglect the cleaning operation in order to avoid the time or expense associated with the cleaning operation. In addition, while the printer may include a display that prompts the operator regarding the cleaning operation, the prompts can be confusing and frustrating to the user, resulting in additional delay or neglect in cleaning. For example, the operator might use a cleaning card that has already been used, or the operator may perform the cleaning operation using a piece of stock material instead of the cleaning card.

Another drawback to conventional media cleaning operations of the type described above is that they typically do not prevent initial contamination of the media feed path. Rather, they simply allow dust and other contaminants located on the opposed surfaces of the print media to be re-deposited at various locations as the printable media is driven along the media feed path. Cleaning cards are fed through the device only after multiple units of print media have been processed with contaminant deposits in place. In this regard, such media cleaning operations inherently provide lower levels of media processing performance than would be possible if such contaminants were isolated from the media path altogether.

Another conventional cleaning operation involves using a cleaning station located upstream from a printing station to clean a first surface of a media unit prior to printing on the first surface. The media unit is then flipped and an opposed surface of the media unit is cleaned prior printing on the opposed surface. However, this configuration requires a complex flipping mechanism that not only adds cost to the printer, but also requires the media unit to make two separate passes through the cleaning and printing stations. This increases the time it takes to process each media unit and thereby decreases the overall throughput of the printer.

Thus, there exists a need for an improved apparatus and method for isolating dust, debris, oils, and other contaminants from the feed path of a media feed device. The apparatus and method should provide effective cleaning of opposed surfaces of a printable media, thereby isolating sensitive media processing operations within the device from contamination. In addition, the apparatus and method should be automatically performed and have little or no negative effect on throughput of the media feed device.

DETAILED DESCRIPTION OF THE INVENTION

The present invention now will be described more fully hereinafter with reference to the accompanying drawings, in which some, but not all embodiments of the invention are shown. Indeed, the present invention may be embodied in many different forms and should not be construed as limited to the embodiments set forth herein; rather, these embodiments are provided so that this disclosure will satisfy applicable legal requirements. Like numbers refer to like elements throughout.

The present invention provides a cleaning assembly capable of easily and efficiently cleaning surfaces of a media unit. In one embodiment, the cleaning assembly automatically removes debris to a replaceable component such as a ribbon cartridge. In various embodiments, the cleaning assembly includes a first cleaning structure that engages a second cleaning structure at least intermittently, and a media feed path that passes between the first cleaning structure and the second cleaning structure. The cleaning assembly may also include at least a third cleaning structure that engages the second cleaning structure at least intermittently. The cleaning structures may each possess a cleaning surface having an adherence level. In one embodiment, the second cleaning structure defines a surface adherence level that is greater than a surface adherence level of the first cleaning structure, and the third cleaning structure defines a surface adherence level that is greater than the surface adherence level of the second cleaning structure.

Cleaning assemblies according to various embodiments are depicted in FIGS. 1-9 as defined along coordinate axes X-Y-Z for illustration purposes. Such coordinate axes definitions are readily alterable without deviating from the inventive concepts herein described and, therefore, should not be construed as limiting.

Figure 1:
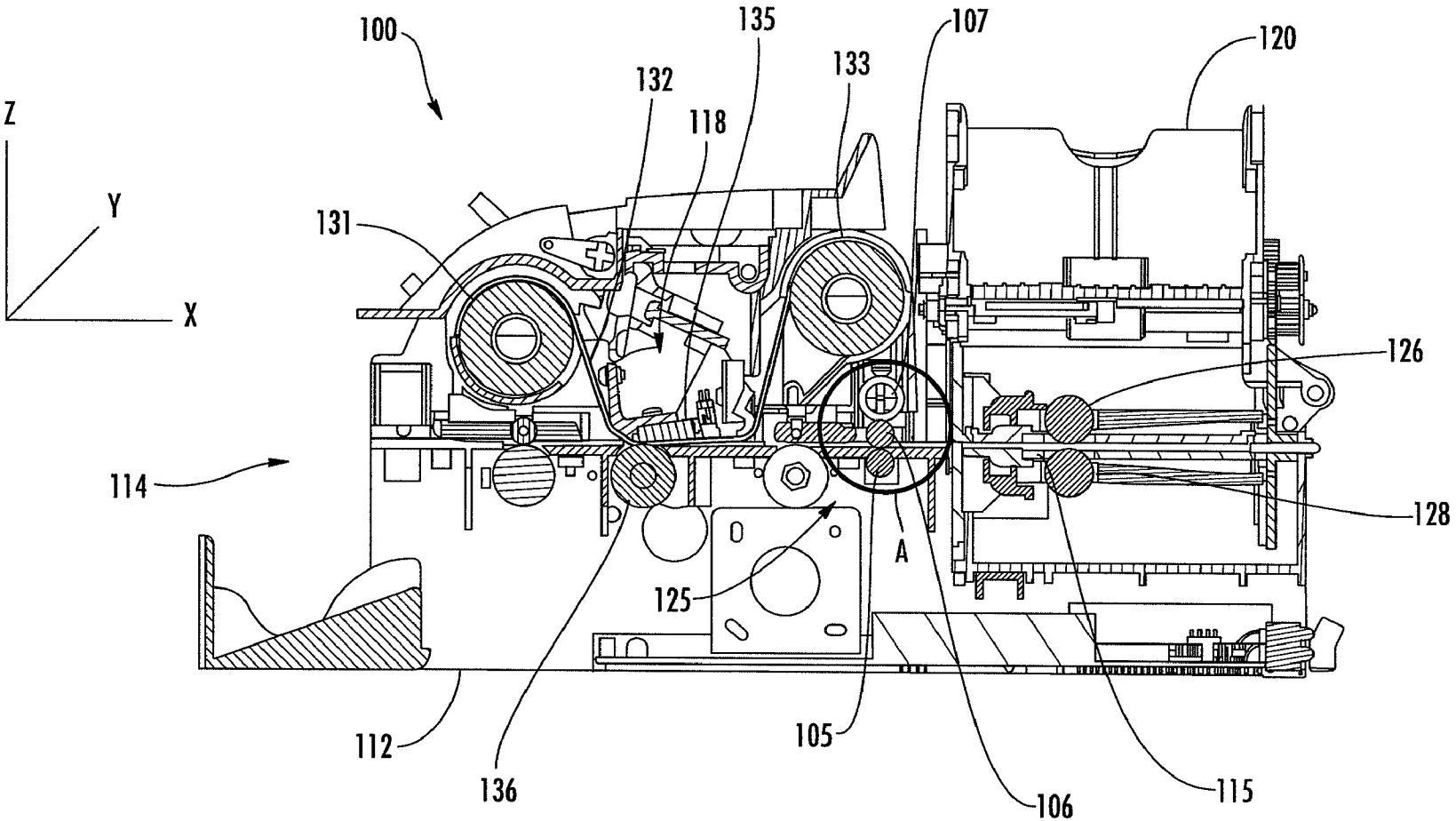
FIG. 1 is a cross section view of a printer incorporating a cleaning assembly in accordance with one embodiment of the present invention.

FIG. 1 illustrates a section view of a thermal transfer printer 100 incorporating a cleaning assembly in accordance with one embodiment of the present invention. As is known, thermal transfer printers may be used to print information such as text, graphics, photographs, and other indicia, onto various media including plastic cards such as I.D. cards, drivers' licenses, and the like. Other printers may be adapted to print labels, photographic paper, standard paper, etc. As will be apparent to one of ordinary skill in the art, cleaning assemblies according to various embodiments of the present invention may be adapted for use in any printer where it is useful for the printable media to be cleaned. This includes printers configured for printing cards, labels, photographic paper, etc. The foregoing specification describes the depicted thermal transfer printer 100 as a card printer merely for illustration purposes and, thus, this description should not be construed as limiting.

The depicted thermal transfer printer 100 includes a printer body or frame 112, a feed station 120, a cleaning station 125, a discharge station 114, and a print station 118. Individual media cards 115, such as PVC cards, are transported in succession from right to left, as viewed in FIG. 1, along a substantially horizontal media feed path between the feed station 120 and the discharge station 114. The print station 118 includes a printhead 135 and a platen roller 136. Ribbon transfer media 132 may be played out from a ribbon cartridge located in the printer frame 112. In operation, the ribbon transfer media 132 is drawn from a ribbon supply roll 133, between the printhead 135 and the platen roller 136, to a ribbon take-up roll 131. Typically, the ribbon cartridge (housing the ribbon supply roll 133 and ribbon take-up roll 131) is a removable, replaceable unit that is disposed of by an operator when the ribbon 132 has been spent.

As will be apparent to one of ordinary skill in the art, the feed station 120 may include a pair of opposed, counter-rotating, substrate drive rollers 126, 128 for transporting individual media cards along the media feed path toward the cleaning assembly 125. In the depicted embodiment, a media card 115 is transferred from the feed station 120 to the cleaning assembly 125 along the media feed path. In one embodiment, the cleaning assembly 125 includes a first cleaning structure 105, a second cleaning structure 106, and a third cleaning structure 107. In the depicted embodiment, the first cleaning structure 105, the second cleaning structure 106, and the third cleaning structure 107 comprise cleaning rollers, wherein the first cleaning structure 105 and second cleaning structure 106 are cylindrical members that are capable of rotatable engagement with one another. The third cleaning structure 107 is a rotatable cylindrical member that is capable of engaging the second cleaning structure 106. In one embodiment, the third cleaning structure 107 may be rotatably mounted to or within the replaceable ribbon cartridge as discussed in greater detail below. In other embodiments, however, the first cleaning structure 105, the second cleaning structure 106, and/or the third cleaning structure 107 may mounted within or supported by a replaceable cleaning cartridge (not shown). In still other embodiments, each of the first cleaning structure 105, the second cleaning structure 106, and the third cleaning structure 107 may be supported directly by the mechanical frame or infrastructure of the printer itself.

In the depicted embodiment, the first cleaning structure 105, the second cleaning structure 106, and the third cleaning structure 107 are oriented such that their longitudinal axes are substantially perpendicular to the media feed path. The first cleaning structure 105 is positioned in rolling contact with the second cleaning structure 106 and the interface defined therebetween is aligned with the media feed path such that a media card 115 traveling from the feed station 120 defines a media cleaning feed path passing between the first cleaning structure 105 and the second cleaning structure 106.

Figure 2:
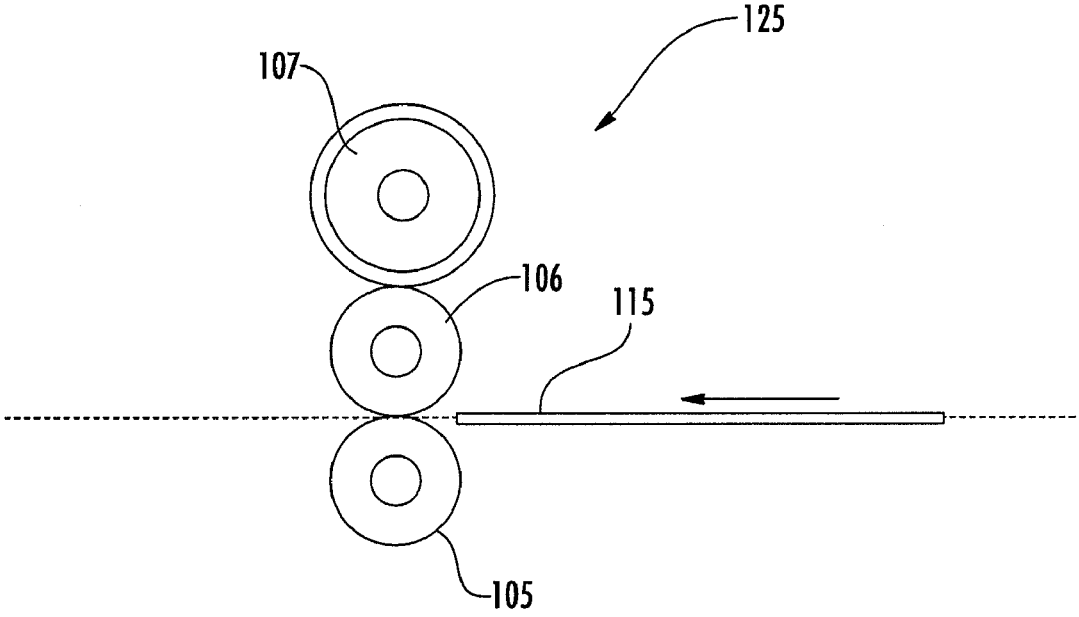
FIG. 2 is a detail view of the cleaning assembly of FIG. 1, taken along detail circle A, in accordance with one embodiment of the invention.

FIG. 2 is a detail view of the cleaning assembly 125 of FIG. 1, taken along detail circle A. In the depicted embodiment, the media card 115 travels along the media feed path into the interface defined between the first cleaning structure 105 and the second cleaning structure 106. In one embodiment, the first cleaning structure 105, the second cleaning structure 106, and the third cleaning structure 107 may be caused to rotate by one or more drive motors independent of the motion of the media card 115.

Figure 3:
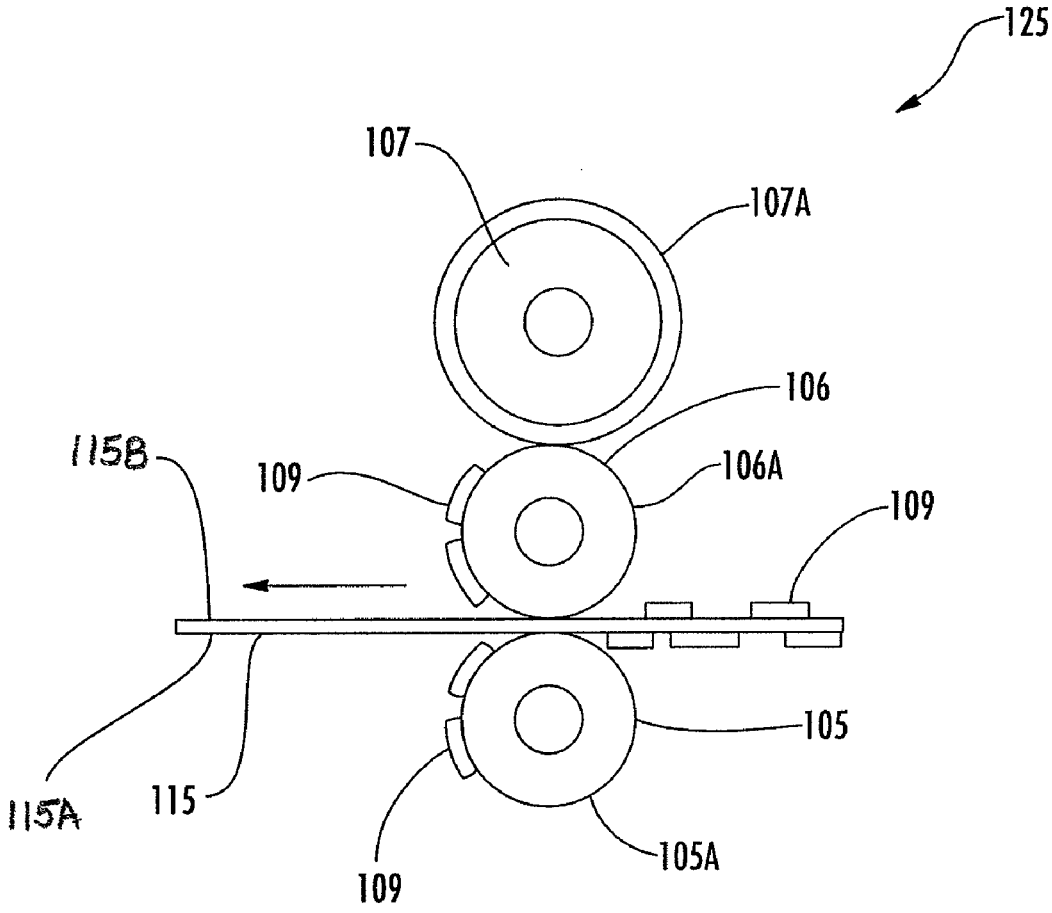
FIG. 3 is a detail view of a cleaning assembly operating to remove debris from a media card in accordance with one embodiment of the invention.

FIG. 3 illustrates a cleaning operation in accordance with one embodiment of the present invention. In the depicted embodiment, the exterior surface of the first cleaning structure 105 defines a first cleaning structure surface 105A having a first adherence level. The exterior surface of the second cleaning structure 106 defines a second cleaning structure surface 106A having a second adherence level. The exterior surface of the third cleaning structure 107 defines a third cleaning structure surface 107A having a third adherence level. As used in the foregoing specification and appended claims the term "adherence" refers to the ability of a surface to form a bond to particulate matter on an adjacent surface. The adherence may be after contact and under pressure, and includes, but is not limited to tack, tackiness, adhesiveness, and electrostatic attraction. This could be accomplished in many ways. For example, a surface may have an approximate tackiness level, electric charge, or durometer level such that the surface bonds to particulate matter on an adjacent surface. The ability of a surface to form a bond to particulate matter on an adjacent surface may be accomplished in many other ways as will be apparent to one of ordinary skill in the art in view of the disclosure provided herein.

The relative adherence of the first cleaning structure surface 105A, the second cleaning structure surface 106A, and the third cleaning structure surface 107A may be defined by the nature of the material used to form the rollers or alternatively, by various adhesive coatings, treatments, coverings, etc., that may be applied to the respective surfaces. For example, in one embodiment, the first cleaning structure surface 105A may be coated with nitrile and the second cleaning structure surface 106A may be coated with silicone to achieve specific adherence levels, while the third cleaning structure surface 107A may be covered with a pre-coated adhesive tape.

Figure 4:
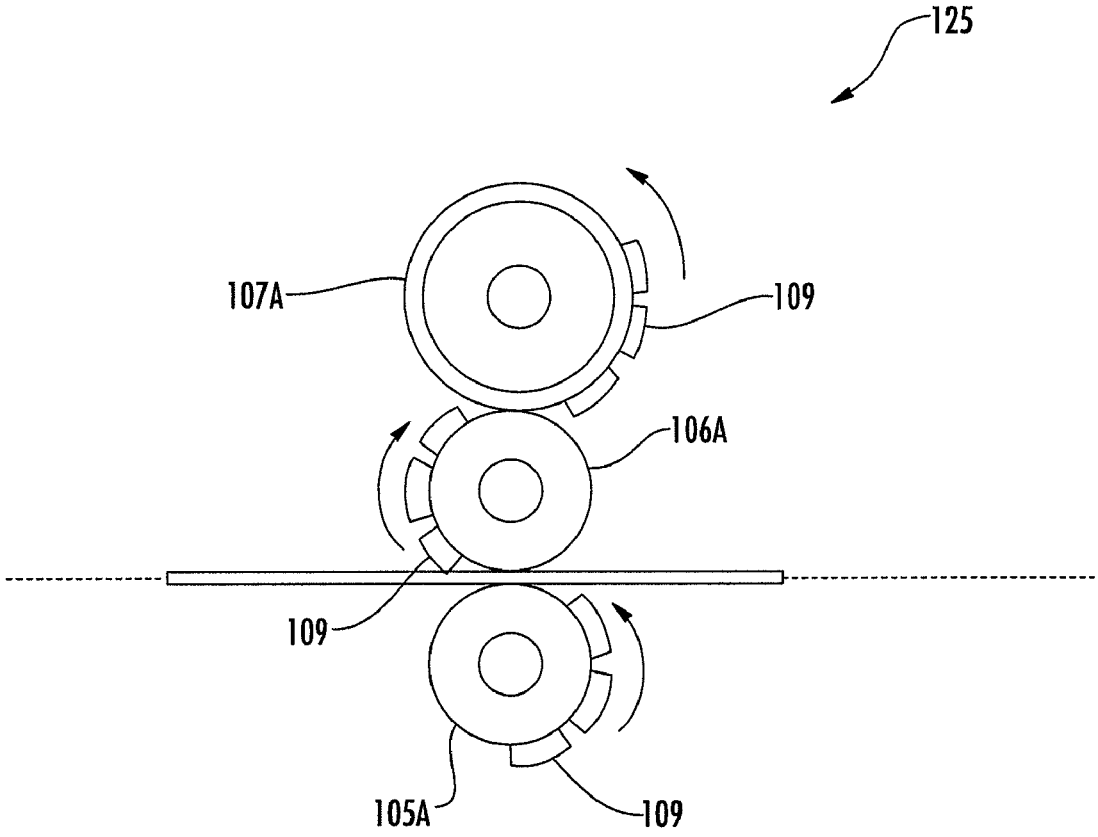
FIG. 4 is a detail view of a cleaning assembly operating to transfer debris between rollers in accordance with one embodiment of the invention.

FIGS. 3 and 4 are side detail views of the embodiment depicted in FIG. 2 as viewed along the media feed path. The depicted embodiments illustrate a removal path for dust, dirt, oil, ink, dye, and other debris (referred to collectively as debris 109) according to one embodiment of the present invention. The relative size of the debris 109 has been exaggerated for illustration purposes and should not be construed as drawn to scale. Various substrates including media cards 115 and the like tend to accumulate debris 109 prior to printing or other media processing operations. The debris 109 typically collects along opposed surfaces of the media substrate as shown in FIG. 3. As noted above, such debris 109 may be damaging to media processing operations and, thus, it is desirable to drive debris-containing media through a cleaning assembly 125 prior to printing or other media processing operations.

In the depicted embodiment, a debris-containing media card 115 is driven through a cleaning assembly 125 in accordance with one embodiment of the present invention. As referenced above, the first cleaning structure surface 105A and the second cleaning structure surface 106A each have a surface adherence level that is greater than the relatively nominal surface adherence of the media card 115. Additionally, the second cleaning structure surface 106A has an adherence level that is greater than the adherence level of the first cleaning structure surface 105A. Likewise, the third cleaning structure surface 107A has an adherence level that is greater than the adherence level of the second roller surface 106A. As such, the first cleaning structure 105, the second cleaning structure 106, and the third cleaning structure 107 create a cleaning assembly 125 wherein debris 109 is removed from one or more surfaces of the media card 115.

The depicted cleaning assembly 125 operates as follows. A debris-containing media card 115 travels along the media feed path into the interface defined between the first cleaning structure 105 and the second cleaning structure 106. The first cleaning structure surface 105A rotatably engages a first surface 115A of the media card 115 thereby removing debris 109 disposed on the first surface 115A. Similarly, the second cleaning structure surface 106A rotatably engages a second surface 115B of the media card 115 thereby removing debris 109 that has collected on the second surface 115B.

In one embodiment, a drive motor or other similar device is provided to drive one or more of the first cleaning structure 105, the second cleaning structure 106, and the third cleaning structure 107. In other embodiments, multiple drive motors may be provided to drive the respective cleaning rollers 105, 106, and 107. In this regard, and in combination with the relative adherence of the cleaning rollers, the progressive cleaning assemblies of various embodiments of the present invention are adapted to be self-cleaning. For example, in one embodiment, as shown in FIG. 4, the respective cleaning rollers 105, 106, and 107 are adapted to perform self-cleaning during time intervals defined between receiving successive media cards along the media feed path. In particular, self-cleaning occurs as the trailing edge of a media card 115 passes through the interface defined between the first cleaning structure 105 and the second cleaning structure 106. As the trailing edge leaves the interface, the first cleaning structure 105 continues to rotatably engage the second cleaning structure 106. As referenced above, the second cleaning structure surface 106A has an adherence level that is greater than that of the first cleaning structure surface 105A. Accordingly, debris 109 that has been temporarily retained on the first cleaning structure surface 105A will tend to be transmitted across the media feed path to the second cleaning structure surface 106A as shown.

In another embodiment, the second cleaning structure 106 is configured in rotatable engagement with a third cleaning structure 107. The third cleaning structure surface 107A has a adherence level that is greater than that of the second cleaning structure surface 106A and, thus, debris 109 that has collected on the second cleaning structure surface 106A is received by the third cleaning structure surface 107A. In this regard, as will be apparent to one of ordinary skill in the art in view of the disclosure provided above, debris 109 is ultimately transferred from opposed surfaces of one or more media cards 115 to the third cleaning structure surface 107A.

In various embodiments of the present invention, the third cleaning structure 107 may be adapted to be removable and replaceable. In one embodiment, the third cleaning structure 107 is provided within or supported by a replaceable ribbon cartridge as noted above. In other embodiments, the third cleaning structure 107 may be supported within its own separately replaceable cleaning cartridge (not shown). In still other embodiments, the exterior adhesive surface of the third cleaning structure 107 may be replaced, for example, by removing an outer layer of adhesive tape. In such embodiments, the second and/or third cleaning structures 106, 107 may be adapted for slight repositioning to ensure continuing rotatable engagement between all three cleaning rollers.

In another embodiment of the present invention, a surface durometer or relative softness of the cleaning structures may be adapted to assist in debris removal. For example, in one embodiment, the first cleaning structure surface 105A may define a first adherence level corresponding to a durometer of the first cleaning structure surface 105A and the second cleaning structure surface 106A may define a second adherence level corresponding to a durometer of the second cleaning structure surface 106A, such that the adherence level of the second cleaning structure surface 106A is greater than the adherence level of the first cleaning structure surface 105A. In other embodiments, the third cleaning structure surface 107A may define a third adherence level corresponding to a durometer of the third cleaning structure surface 107A, such that the adherence level of the third cleaning structure surface 107A is greater than the adherence level of the second cleaning structure surface 106A. As will be apparent to one of ordinary skill in the art in view of the disclosure provided above, the relatively firm surface of the first cleaning structure 105 will tend to transmit debris to the relatively softer surface of the second cleaning structure 106. Debris collected on the second cleaning structure 106 will then be received by the more adherent surface of the third cleaning structure 107. In this regard, debris may be systematically transferred from opposed surfaces of one or more media cards to the third cleaning structure surface 107A. For example, in one embodiment, the first cleaning structure surface 105A may be coated with nitrile having a Shore A durometer level of approximately 40, the second cleaning structure surface 106A may be coated with silicone having a Shore A durometer level of 20, and the third cleaning structure surface 107A may covered with a pre-coated adhesive tape.

Figure 5:
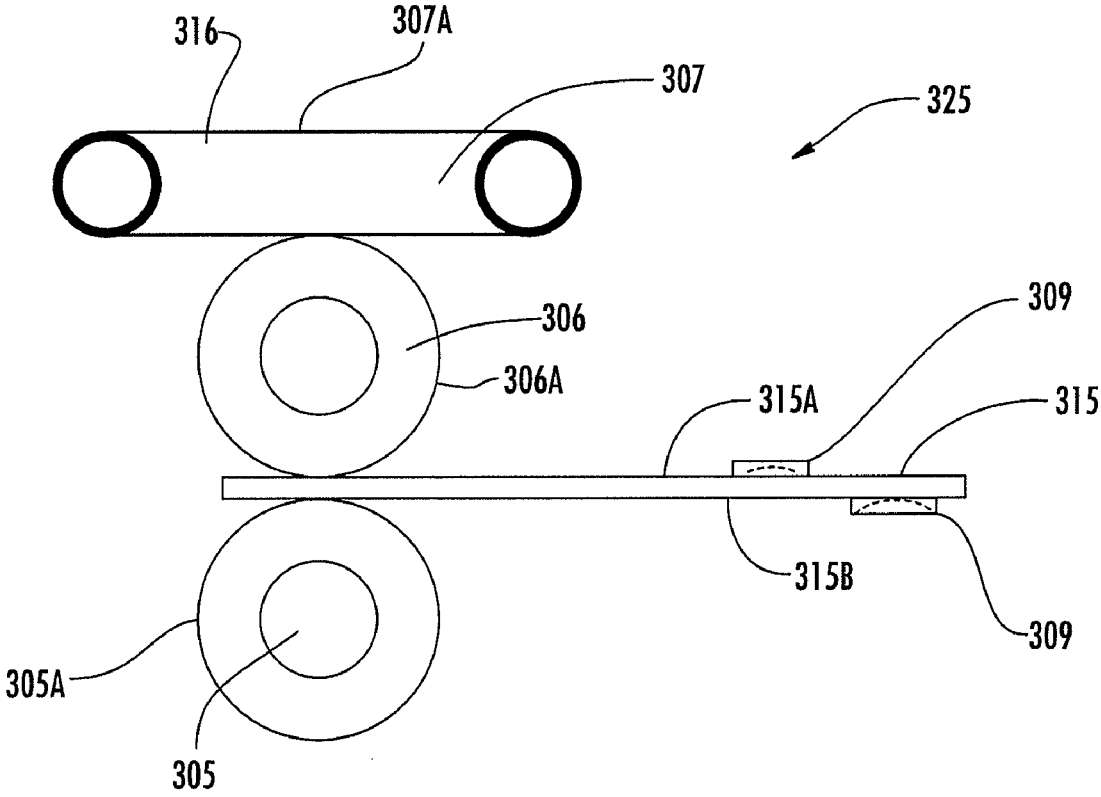
FIG. 5 is a detail view of a cleaning assembly in accordance with another embodiment of the invention.

It should be noted that although the cleaning structures 105, 106, 107, depicted in FIGS. 1-4 are cleaning rollers, any one, any combination, or all of the cleaning structures of the present invention may comprise other structures capable of removing debris, including but not limited to cleaning belts, films, and pads. For example, FIG. 5 shows a cleaning assembly 325 structured to clean debris 309 from surfaces 315A and 315B of a media card 315 in a similar manner as that described above. In the depicted embodiment, the first cleaning structure 305 and the second cleaning structure 306 are cleaning rollers. As described above, the exterior surface of the first cleaning structure 305 defines a first cleaning structure surface 305A having a first adherence level, and the exterior surface of the second cleaning structure 306 defines a second cleaning structure surface 306A having a second adherence level. In the depicted embodiment, the third cleaning structure 307 comprises a cleaning belt 316. The exterior surface of the cleaning belt 316 of the third cleaning structure 307 defines a third cleaning structure surface 307A having a third adherence level. In the depicted embodiment, the first cleaning structure surface 305A and the second cleaning structure surface 306A each have a surface adherence level that is greater than the relatively nominal surface adherence level of the media card 315, and the second cleaning structure surface 306A has an adherence level that is greater than the adherence level of the first cleaning structure surface 305A. Likewise, the third cleaning structure surface 307A has an adherence level that is greater than the adherence level of the second cleaning structure surface 306A. As such, the first cleaning structure 305, the second cleaning structure 306, and the third cleaning structure 307 create a cleaning assembly 325 wherein debris is removed from one or more surfaces of the media card 315 and subsequently transferred to the third cleaning structure 307 as similarly described above.

Figure 6:
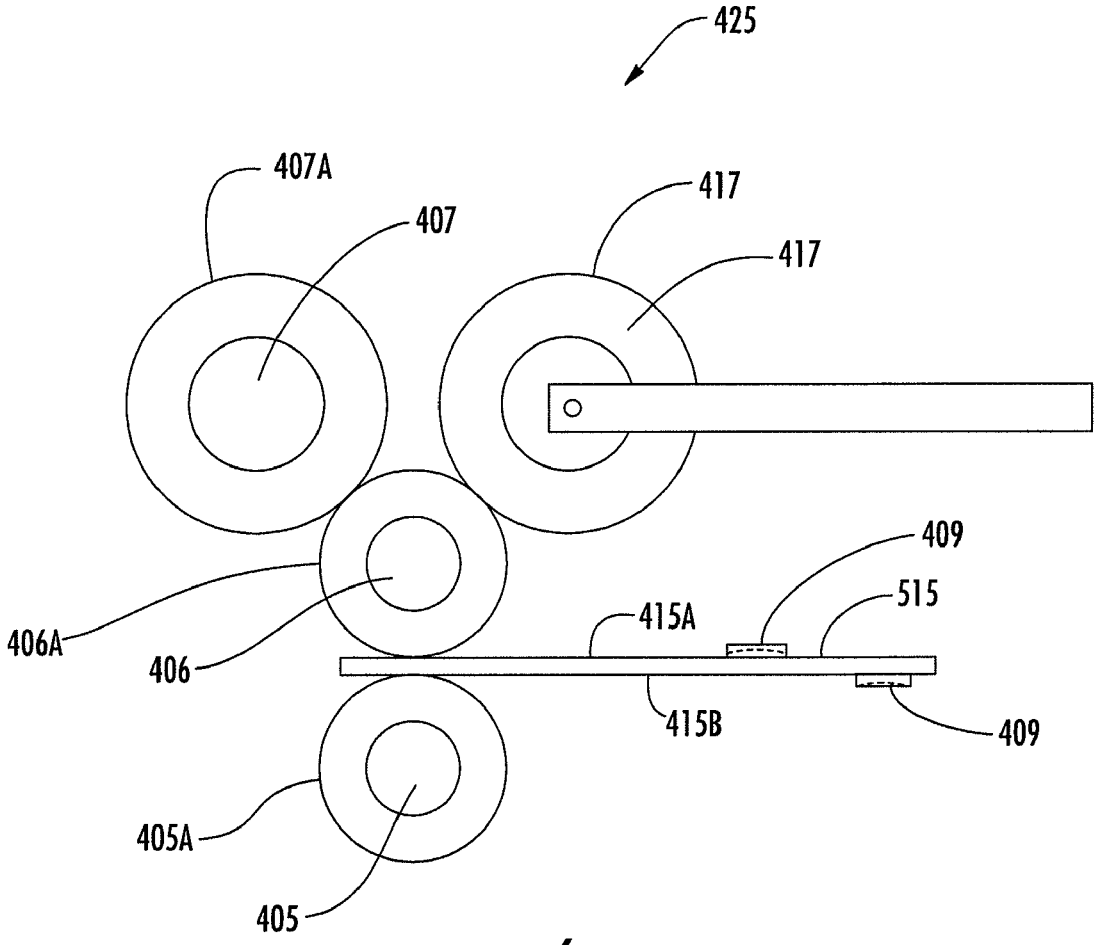
FIG. 6 is a detail view of a cleaning assembly in accordance with another embodiment of the invention.

In other embodiments, additional cleaning structures may be included. For example, FIG. 6 shows a cleaning assembly 425 having a first cleaning structure 405, a second cleaning structure 406, a third cleaning structure 407, and a fourth cleaning structure 417. Each of the cleaning structures defines cleaning surfaces 405A, 406A, 407A, and 417A, respectively, such that debris 409 collected from surfaces 415A and 415B of media card 415 is transferred to third cleaning structure 407 and fourth cleaning structure 417. As such, the fourth cleaning structure 417 may add additional storage capacity for debris collected from the media card 415.

Figure 7:
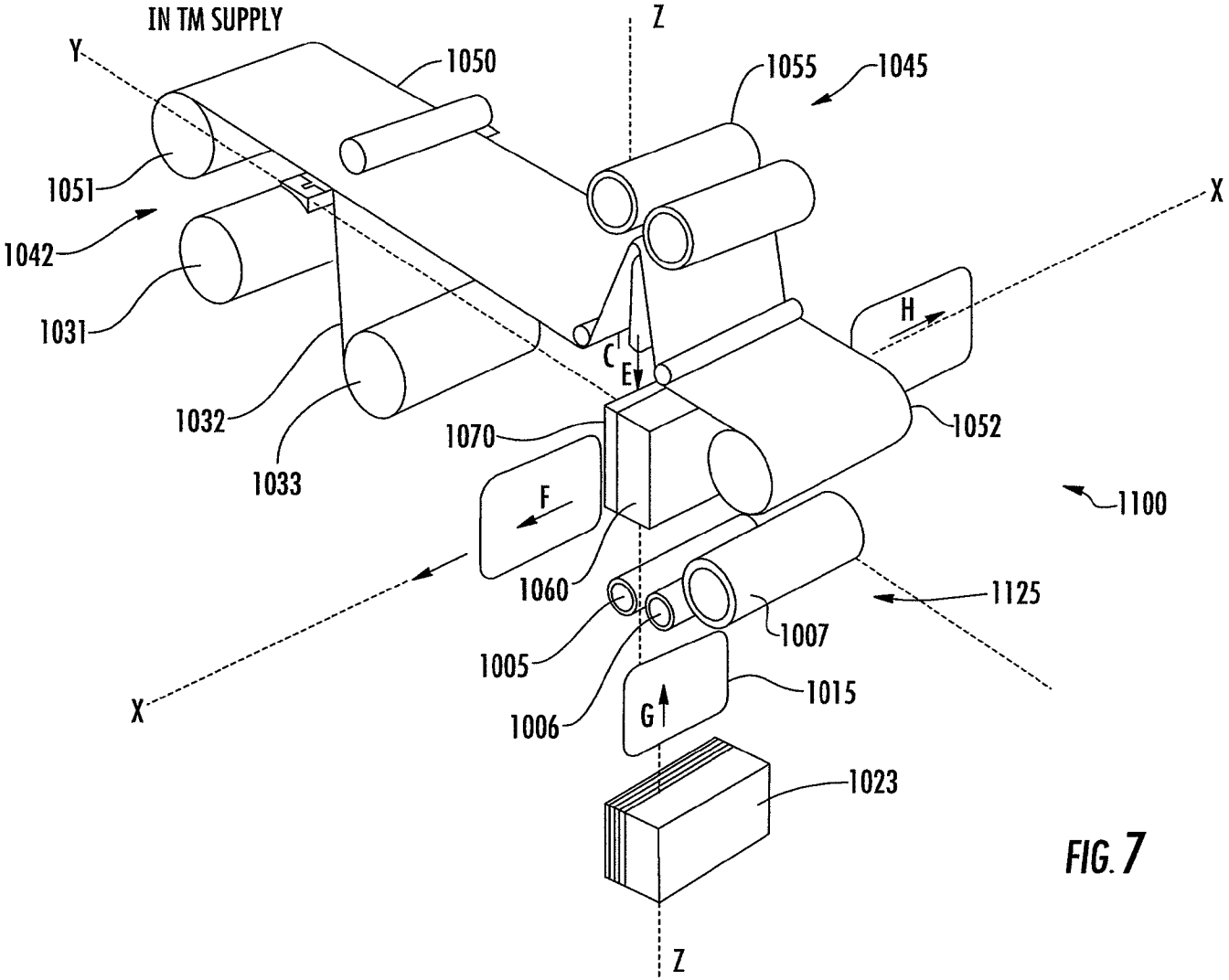
FIG. 7 is a schematic illustration of a printer incorporating a double-sided printing assembly and a cleaning assembly in accordance with another embodiment of the invention.
Figure 8:
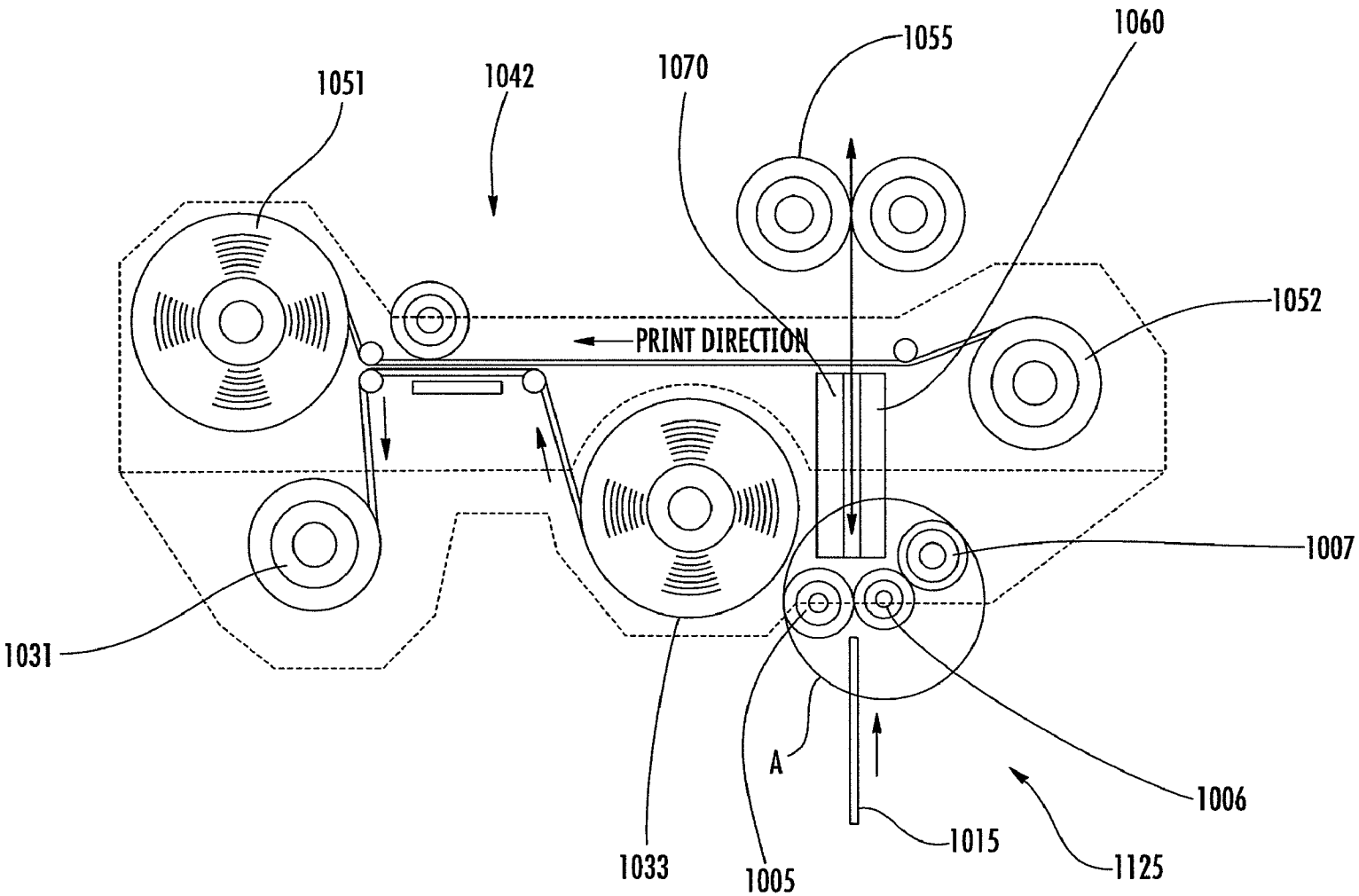
FIG. 8 is a side schematic view of the printer embodiment shown in FIG. 7.

Other embodiments of the present invention are depicted in FIGS. 7 and 8. For example, FIG. 7 illustrates a cleaning assembly 1125 having a first cleaning structure 1005, a second cleaning structure 1006, and a third cleaning structure 1007. In the depicted embodiment, the first cleaning structure 1005 and the second cleaning structure 1006 are cylindrical members that are capable of rotatable engagement with one another. The third cleaning structure 1007 is a cylindrical member that is disposed in rotatable engagement with the second cleaning structure 1006. In various embodiments, one or more of the cleaning rollers may be adapted to translate relative to the other cleaning rollers in order to disengage from rotatable engagement. Such translation may be appropriate, for example, where it is desired for media to periodically bypass the cleaning station. In such embodiments, the first and second cleaning structures may be adapted to selectively separate thereby allowing media to pass along the feed path without contacting the cleaning rollers. In other embodiments, the third cleaning structure may be adapted to periodically disengage from the second cleaning structure for other purposes, for example, to reduce drag on either cleaning roller.

In the depicted embodiment, the third cleaning structure 1007 is mounted to a replaceable ribbon cartridge as shown in greater detail by FIG. 8. In other embodiments, one or more of the first cleaning structure 1005, the second cleaning structure 1006, and/or the third cleaning structure 1007 may supported by a separately replaceable cleaning cartridge (not shown). Also, in still other embodiments, each of the first cleaning structure 1005, the second cleaning structure 1006, and the third cleaning structure 1007 may be mounted for individual replacement within a printer or other media processing device.

In the depicted embodiment, the first cleaning structure 1005, the second cleaning structure 1006, and the third cleaning structure 1007 are oriented such that their longitudinal axes are substantially parallel to an X-axis. Unlike the embodiment depicted in FIG. 1, where the cleaning rollers are generally aligned along the Z-axis, the cleaning rollers depicted in FIG. 8 are generally aligned along the Y-axis. In this regard, the depicted cleaning rollers are configured to receive media cards 1015 traveling from feed station 1023 along a Z-axis feed path as shown. By altering the positioning the cleaning rollers one may provide flexibility in the media processing architecture of a printer or other device. This flexibility may be further enhanced by incorporating a single-pass double-sided printing assembly and/or a cross feed media processing architecture of the type depicted in FIGS. 7 and 8. The depicted single-pass double-sided printing assembly and cross feed media architecture are described in greater detail by commonly owned U.S. Provisional Patent Application No. 60/673,203, which is incorporated herein by reference.

Figure 9:
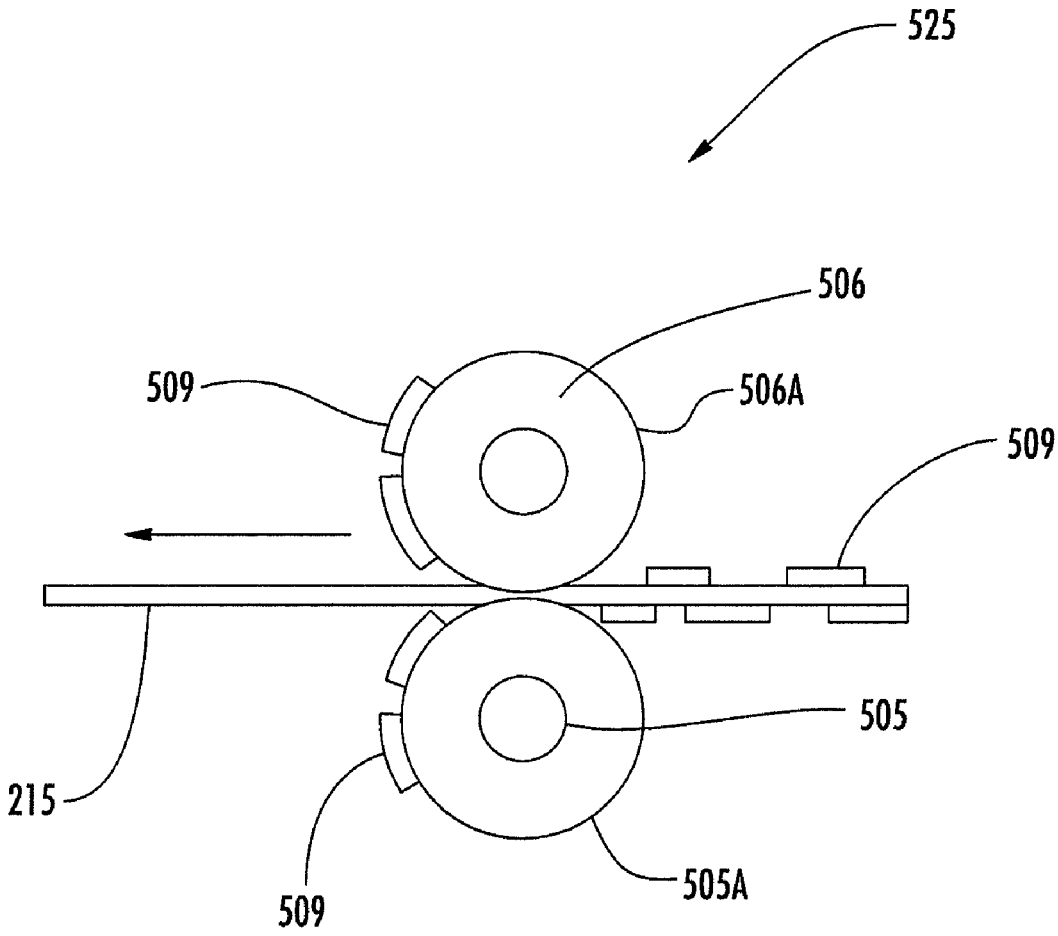
FIG. 9 is a detail view of a cleaning assembly in accordance with another embodiment of the invention.

Although the embodiments depicted in FIGS. 1-8 include a third cleaning structure, other embodiments of the present invention may omit the third cleaning structure and, thus, include only first and second cleaning structures. Such embodiments may be particularly advantageous where a second cleaning structure is mounted within or supported by a replaceable cartridge (not shown). One such cleaning assembly is illustrated in FIG. 9. In the depicted embodiment, cleaning assembly 525 includes a first cleaning structure 505 defining a first cleaning structure surface 505A having a first adherence level and a second cleaning structure 506 defining a second cleaning structure surface 506A having a second adherence level. In the depicted embodiment, the first cleaning structure 505 and the second cleaning structure 506 are cleaning rollers. As referenced above, the cleaning assembly 525 is self-cleaning in that debris is transferred from one cleaning structure to another. In the depicted embodiment, the second adherence level of the second cleaning structure surface 506A is greater than the first adherence level of the first cleaning structure surface 505A. During operation of the cleaning assembly, debris 509 is removed from the debris-containing media card 515 to the first and second cleaning structure surfaces 505A, 506A as shown. In one embodiment, debris 509 is generally transferred from the first cleaning structure surface 505A to the relatively tackier second cleaning structure surface 506A as the first cleaning structure surface 505A rotatably engages the second cleaning structures surface 506A during intervals between successive media cards. As the second cleaning structure surface 506A becomes saturated with debris it may be replaced according to various embodiments as discussed above.

Various embodiments of the present invention provide a double-sided media cleaning apparatus for use in a media processing device such as a printer. The cleaning assemblies of various embodiments of the present invention provide for effective and efficient cleaning of opposed surfaces of the media automatically, thereby improving operation of the media processing device. The cleaning assemblies also isolate and prevent initial contamination of the feed path from dust, debris, oils, and other contaminants. Additionally, by providing a series of cleaning structures that have different levels of surface adherence, the above described cleaning assemblies transfer debris onto a replaceable component of the system, thereby providing a system that is self-cleaning with limited operator intervention.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cleaning assembly adapted to remove debris from a media unit having first and second surfaces wherein the media unit travels along a media feed path having first and second sides, the cleaning assembly comprising:

a cleaning station positioned along said media feed path, said cleaning station comprising:

a first cleaning structure located on the first side of the media feed path and configured to remove debris from the first surface of the media unit; and a second cleaning structure located on the second side of the media feed path and configured to remove debris from the second surface of said media unit;

wherein said first and second cleaning structures are constructed and arranged such that debris removed by said first cleaning structure is transmitted across the media feed path upon exit of the media unit from said cleaning station, wherein said first and second cleaning structures are adapted to at least intermittently mutually engage to transmit collected debris from a first cleaning surface of said first cleaning structure to a second cleaning surface of said second cleaning structure during said intermittent mutual engagement, wherein said first cleaning surface comprising a first adherence level and said second cleaning surface comprising a second adherence level, wherein said first and second cleaning structures remove debris from the media unit by intermittently engaging the respective first and second surfaces of the media unit, and wherein said second adherence level of said second cleaning surface is greater than said first adherence level of the first cleaning surface, further comprising a third cleaning structure including a third cleaning surface comprising a third adherence level, wherein said third cleaning surface of said third cleaning structure receives at least a portion of said debris from said first and second cleaning structures by at least intermittently engaging said second cleaning surface of said second cleaning structure, and wherein said third adherence level of said third cleaning surface is greater than said second adherence level of said second cleaning surface.

2. The cleaning assembly of claim 1, wherein the cleaning station is replaceable and adapted to be received along the media feed path.

3. A media processing device adapted to receive a media unit having first and second surfaces wherein the media unit travels along a media feed path having first and second sides, the media processing device comprising:

a printing assembly disposed along the media feed path for receiving the media unit; and a cleaning station positioned along the media feed path, said cleaning station comprising:

a first cleaning structure located on the first side of the media feed path and configured to remove debris from the first surface of the media unit; and a second cleaning structure located on the second side of the media feed path and configured to remove debris from the second surface of the media unit;

wherein said first and second cleaning structures are constructed and arranged such that debris removed by said first cleaning structure is transmitted across the media feed path upon exit of the media unit from said cleaning station, said first and second cleaning structures are adapted to at least intermittently mutually engage to transmit collected debris from a first cleaning surface of said first cleaning structure to a second cleaning surface of said second cleaning structure during said intermittent mutual engagement, wherein said first cleaning surface comprising a first adherence level and said second cleaning surface comprising a second adherence level, wherein said first and second cleaning structures remove debris from the media unit by intermittently engaging the respective first and second surfaces of the media unit, and wherein said second adherence level of said second cleaning surface is greater than said first adherence level of the first cleaning surface, further comprising a third cleaning structure including a third cleaning surface comprising a third adherence level, wherein said third cleaning surface of said third cleaning structure receives at least a portion of said debris from said first and second cleaning structures by at least intermittently engaging said second cleaning surface of said second cleaning structure, and wherein said third adherence level of said third cleaning surface is greater than said second adherence level of said second cleaning surface.

4. The media processing device of claim 3, further comprising at least one of a magnetic encoder station, a smart card contact station, and a lamination station.

5. The media processing device of claim 3, wherein the cleaning station is replaceable and adapted to be received along the media feed path.

6. A cleaning cartridge adapted to be removably installed in a media processing apparatus, the cleaning cartridge comprising:

a first cleaning structure arranged such that when the cleaning cartridge is installed in said media processing apparatus, the first cleaning structure is located on a first side of a media feed path and configured to remove debris from a first surface of a media unit;

a second cleaning structure arranged such that when the cleaning cartridge is installed in said media processing apparatus, the second cleaning structure is located on a second side of the media feed path and configured to remove debris from a second surface of the media unit, wherein said first and second cleaning structures are constructed and arranged such that debris removed by said first cleaning structure is transmitted across the media feed path upon exit of the media unit from between said first and second cleaning structures, wherein said first and second cleaning structures are adapted to at least intermittently mutually engage to transmit collected debris from a first cleaning surface of said first cleaning structure to a second cleaning surface of said second cleaning structure during said intermittent mutual engagement, wherein said first cleaning surface comprising a first adherence level and said second cleaning surface comprising a second adherence level, wherein said first and second cleaning structures remove debris from the media unit by intermittently engaging the respective first and second surfaces of the media unit, and wherein said second adherence level of said second cleaning surface is greater than said first adherence level of the first cleaning surface; and a third cleaning structure including a third cleaning surface comprising a third adherence level, wherein said third cleaning surface of said third cleaning structure receives at least a portion of said debris from said first and second cleaning structures by at least intermittently engaging said second cleaning surface of said second cleaning structure, and wherein said third adherence level of said third cleaning surface is greater than said second adherence level of said second cleaning surface.

* * * * *